US005195687A

United States Patent [19]

Derichs et al.

[11] Patent Number: 5,195,687

[45] Date of Patent: Mar. 23, 1993

[54] TEXTILE TUBE TRANSPORT ASSEMBLY HAVING INDEPENDENT LOADING AND UNLOADING CAPABILITIES

[75] Inventors: Josef Derichs, Monchengladbach; Paul Landmesser, Erkelenz, both of Fed. Rep. of Germany

[73] Assignee: W. Schlafhorst AG & Co., Moenchengladbach, Fed. Rep. of Germany

[21] Appl. No.: 604,123

[22] Filed: Oct. 26, 1990

[30] Foreign Application Priority Data

Oct. 26, 1989 [DE] Fed. Rep. of Germany ..... 3935627

[51] Int. Cl.[5] ..... B65H 54/02; B65G 1/00

[52] U.S. Cl. ..... 242/35.5 R; 414/331

[58] Field of Search ..... 242/35.5 A; 414/331, 414/332, 608

[56] References Cited

U.S. PATENT DOCUMENTS

| | | | |
|---|---|---|---|
| 3,055,518 | 9/1962 | Pearne et al. | 414/331 |
| 3,636,654 | 11/1988 | Rohner et al. . | |
| 3,636,705 | 5/1988 | Rohner et al. . | |
| 3,895,725 | 7/1975 | Mayer | 414/331 X |
| 3,924,762 | 12/1975 | Igel | 414/331 |
| 4,144,961 | 3/1979 | Kasahara et al. | 242/35.5 A |
| 4,621,969 | 11/1986 | Berghäll et al. | 414/331 |
| 4,722,657 | 2/1988 | Grube | 414/331 |
| 4,723,885 | 2/1988 | Grube et al. | 414/331 |
| 4,772,174 | 9/1988 | Küpper | 242/35.5 A |
| 4,858,746 | 8/1989 | Ito et al. | 414/331 X |
| 4,893,483 | 1/1990 | Kawasaki et al. | 242/35.5 A |
| 4,988,252 | 1/1991 | Yamamoto et al. | 242/35.5 A |
| 5,078,565 | 1/1992 | Fritschi et al. | 414/331 |

FOREIGN PATENT DOCUMENTS

| | | | |
|---|---|---|---|
| 8204411 | 11/1982 | Netherlands | 414/331 |

*Primary Examiner*—Daniel P. Stodola
*Assistant Examiner*—Michael R. Mansen
*Attorney, Agent, or Firm*—Shefte, Pinckney & Sawyer

[57] ABSTRACT

A textile production system utilizes a textile spinning machine and a textile winding machine and a transport assembly for transporting the support members between the machines. The transport assembly includes a container having a plurality of vertically spaced, parallel shelf members. Each shelf member includes a plurality of parallel guide channels for receiving tube support members in a row therein. A displacing device is operable to displace the tube support members from a respective shelf member onto the aligned guide channels of a lifting device positioned at an opposite side of the shelf member. The lifting device is operable to transfer the tube support members to a reorienting travel device which reorients multiple, parallel rows of the tube support members into a single row for feeding of the tube support members to the delivery device of the spinning or winding machine.

26 Claims, 6 Drawing Sheets

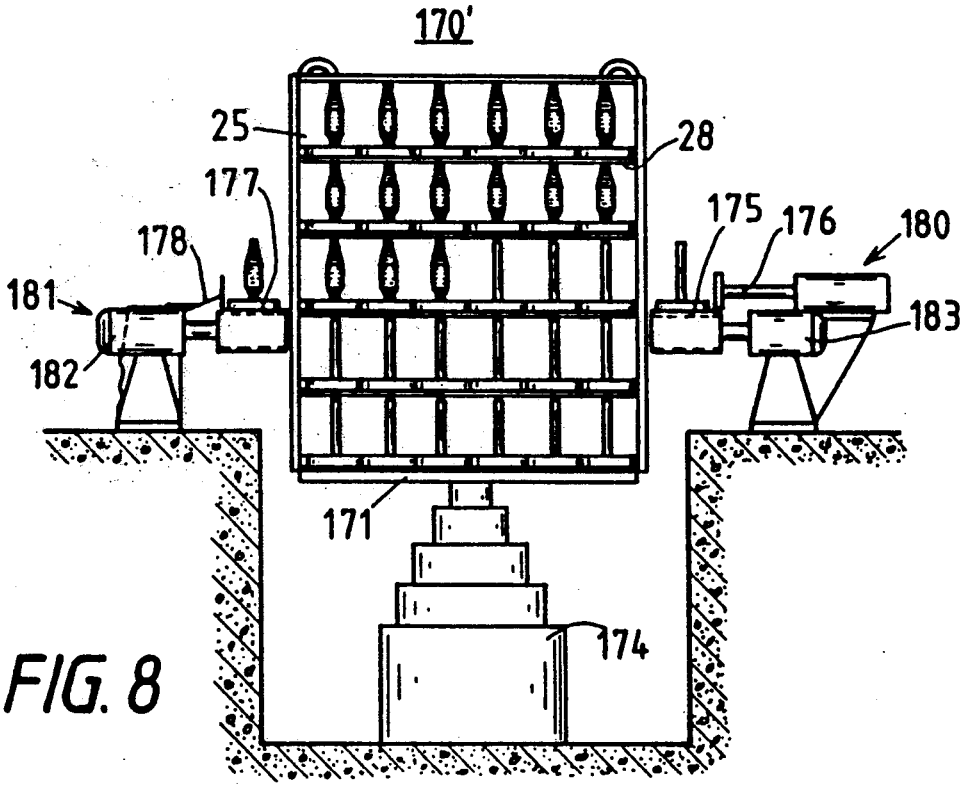
FIG. 8
FIG. 9
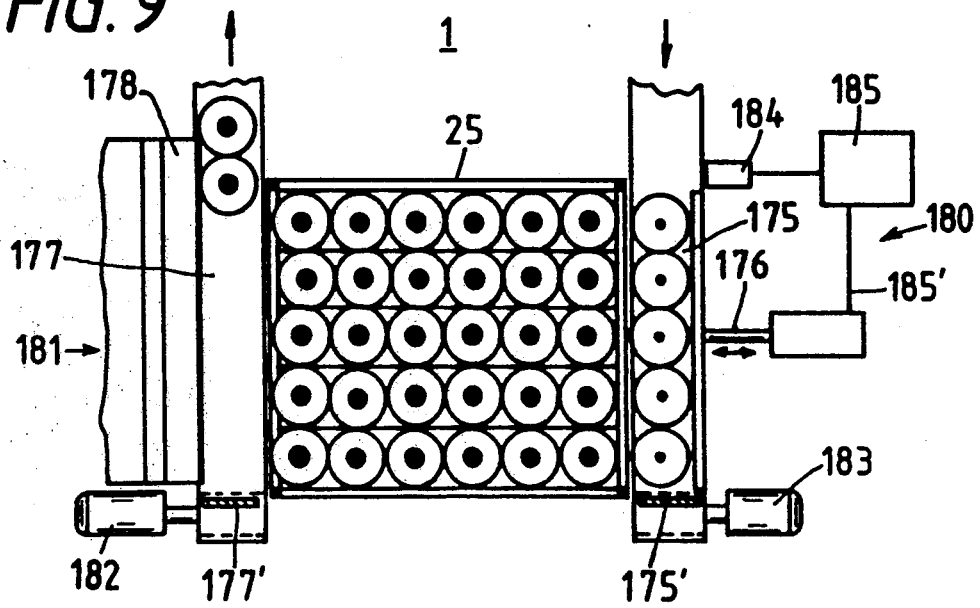

TEXTILE TUBE TRANSPORT ASSEMBLY HAVING INDEPENDENT LOADING AND UNLOADING CAPABILITIES

BACKGROUND OF THE INVENTION

The present invention relates to a textile tube transport assembly having independent loading and unloading capabilities and, more particularly, to a transport assembly for transporting full yarn packages from a textile spinning machine to a textile winding machine and for returning empty tubes from the textile winding machine to the textile spinning machine.

It is known to operatively interconnect a textile spinning machine and a textile winding machine so that the output of full yarn packages produced by the spinning machine is processed by the winding machine. Typically, the spinning machine builds yarn onto tubes which are individually supported in upright dispositions on tube support members, the yarn built on the tubes forming full yarn packages which are then delivered to the winding machine for winding of the yarn packages thereat. The empty tubes are returned from the winding machine to the spinning machine.

In an effort to reduce the transport distance between the spinning and winding machines, it has been common practice to position the two machines as relatively closely as possible. However, this design constraint poses the requirement that the only suitable locations for a system comprising an operatively interconnected spinning machine and winding machine is a location having sufficient space for the disposition of both machines thereat. Accordingly, the need exists for a textile package transport system which permits greater flexibility in the relative spacing of an operatively interconnected spinning machine and winding machine from each other without significantly impacting the cost and operational burdens of the system.

SUMMARY OF THE INVENTION

Briefly described, the present invention provides a transport assembly for delivering tube support members having yarn packages supported thereon from a textile spinning machine to a textile winding machine and for returning tube support members having empty tubes supported thereon from a textile winding machine to a textile spinning machine in a textile production system in which a textile spinning machine is operable to build yarn packages on tubes which are individually supported on tube support members and a textile winding machine having a plurality of winding stations each for winding yarn packages.

The transport assembly preferably includes, in one embodiment, cross location transport means for supporting a plurality of tube support members for groupwise transport thereof between a spinning machine exchange location associated with the spinning machine and a winding machine exchange location associated with the winding machine, the cross location transport means is disposable at each of the exchange locations for the transfer of tube support members between the cross location transport means and the respective textile machine associated with the exchange location and linking means, associated with at least one of the textile machines, for supporting tube support members during travel thereof between the cross location transport means and at least one textile machine, the linking means includes incoming travel support means for supporting a plurality of tube support members which have been transferred thereto from the cross location transport means during travel thereacross of the tube support members to the respective textile machine and outgoing travel support means for supporting a plurality of tube support members which have been transferred thereto from the respective textile machine for travel thereacross to the cross location transport means, the incoming and outgoing travel support means each being operable to support tube support members thereon independently of the other travel support means.

Also, the transport assembly includes ongoing transfer means associated with one of the incoming and outgoing travel support means for effecting the transfer of tube support members between at least one textile machine and one associated incoming and outgoing travel support means contemporaneously with the support of tube support members by the other of the incoming and outgoing travel support means.

In a further feature of the present invention, the transport assembly is adapted for use in a textile production system wherein at least on textile machine is the textile winding machine and the textile winding machine includes a linearly extending delivery path at least a portion of which extends along an axis for delivering tube support members received from the incoming travel support means to the winding stations of the textile winding machine, the tube support members supported by the linearly extending delivery path are arranged in a single file arrangement generally along the axis of the delivery path. The incoming travel support means preferably includes means for supporting tube support members in an arrangement in which at least some of the tube support members are supported in offset relation to the axis of the linearly extending delivery path following the transfer of the tube support members from the cross location transport means to the incoming travel support means and aligning feed means for feeding the tube support members from the incoming travel support means to the linearly extending delivery path.

BRIEF DESCRIPTION OF THE DRAWINGS

FIG. 8 is a front elevational view of a further embodiment of the textile tube transport assembly of the present invention; and FIG. 9 is a plan view of the further embodiment of the transport assembly shown in FIG. 8.

DETAILED DESCRIPTION OF THE PREFERRED EMBODIMENTS

In FIGS. 1–6, one embodiment of the transport assembly of the present invention is illustrated as operatively installed in a textile production system 2 in which a textile spinning machine (not shown) and an automatic textile winding machine 1 are operatively interconnected with one another.

The textile spinning machine is operable to build a plurality of yarn packages 3–9 on a plurality of empty tubes 21–24 which are individually supported on a plurality of tube support members. The tube support members can be, for example, conventional peg tray tube support members of the type having a cylindrical base portion, a coaxial, relatively smaller diameter neck portion and a coaxial peg for receiving a tube inserted thereon. The yarn packages 3–9 built at the textile spinning machine are individually supported on the plurality of tube support members 10–16 for transport to the automatic textile winding machine 1.

The transport assembly of the present invention is operable to deliver the tube support members 10–16 having the yarn packages 3–9 supported thereon from the textile spinning machine to the textile winding machine 1 and is operable for returning the tube support members having the empty tubes 21–24 supported thereon from the textile winding machine 1 to the textile spinning machine. The transport assembly includes a cross location transport for supporting a plurality of tube support for groupwise transport thereof between a spinning machine exchange location associated with the textile spinning machine and a winding machine exchange location associated with the automatic textile winding machine 1.

Figure 3:
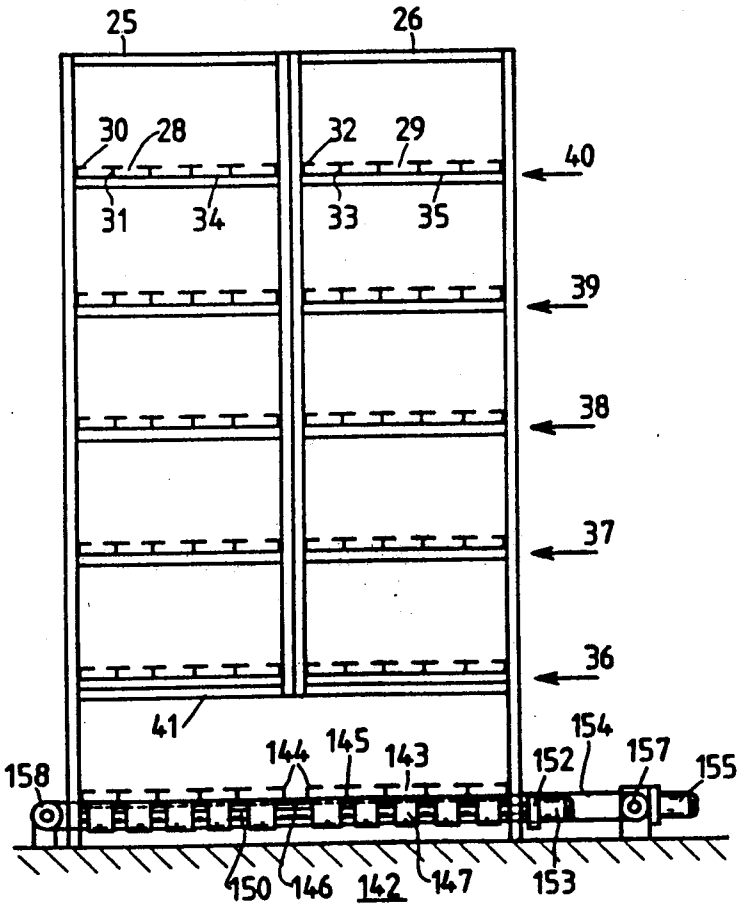
FIG. 3 is a side elevational view of a portion of the textile tube transport assembly shown in FIG. 1.

The cross location transport means 27 is preferably in the form of a pair of multi-level, interconnected container portions 25,26 which each include, as best seen in FIG. 3, a plurality of parallel, vertically spaced shelf members 36–40. The shelf members 36–40 of the container portion 25 includes a plurality of guide members 31 extending parallel to one another at uniform spacings from one another. Each guide rail 34 includes a flange portion 30 extending transversely therefrom and each adjacent pair of the flange portions 30 form an opening for the receipt of the neck portion of a tube support member therein for guiding support of the tube support member.

The container portion 26 includes a plurality of guide members 33 extending parallel to one another at a uniform spacing from one another. Each guide rail 33 includes a flange portion 32 extending transversely therefrom and each adjacent pair of the flange portions 32 forms an opening for receiving the neck portion of a tube support member therein for guiding support of the tube support member. Each adjacent pair of the guide members 31,33 form a guide channel 28,29, respectively, for the guiding of tube support members loaded onto the respective shelf member 36–40. The guide rails 31,33 are mounted on a floor portion 34,35, respectively, which is in the form of a planar, horizontal configuration.

Each of the guide channels 28,29 is open at each end to permit loading and unloading of tube support members from either end of the guide channel. In one variation of the cross location transport means 27, each end of each guide channel 28,29 can be provided with a conventional closure means (not shown) such as, for example, a hinged jealousy-type closure, which selectively prevents the loading and/or unloading of tube support members into the guide channel. Such an arrangement could be particularly beneficial in the event that the cross location transport means 27 is transported across a relatively significant distance in its movement between the spinning machine exchange location and the winding machine exchange location.

The cross location transport means 27 is disposable at each of the exchange locations for the transfer of tube support members between the cross location transport means and the respective textile machine associated with the particular exchange location. For example, as shown in FIGS. 1 and 2, the cross location transport means 27 is disposable at the winding machine exchange location for the transfer of the tube support members 10–16 supporting the yarn packages 3–9 to the automatic textile winding machine 1 and for the receipt of the tube support members supporting the empty tubes 21–24 from the automatic textile winding machine 1.

The transport assembly also includes linking means, associated with at least one of the textile spinning and winding machines, for supporting tube support members during the travel thereof between the cross location transport means 27 and the textile machine. The linking means includes an incoming travel support means for supporting a plurality of tube support members which have been transferred thereto from the cross location transport means 27. The incoming travel support means supports the tube support members for travel thereacross to the respective textile machine associated with the respective exchange location.

Figure 1:
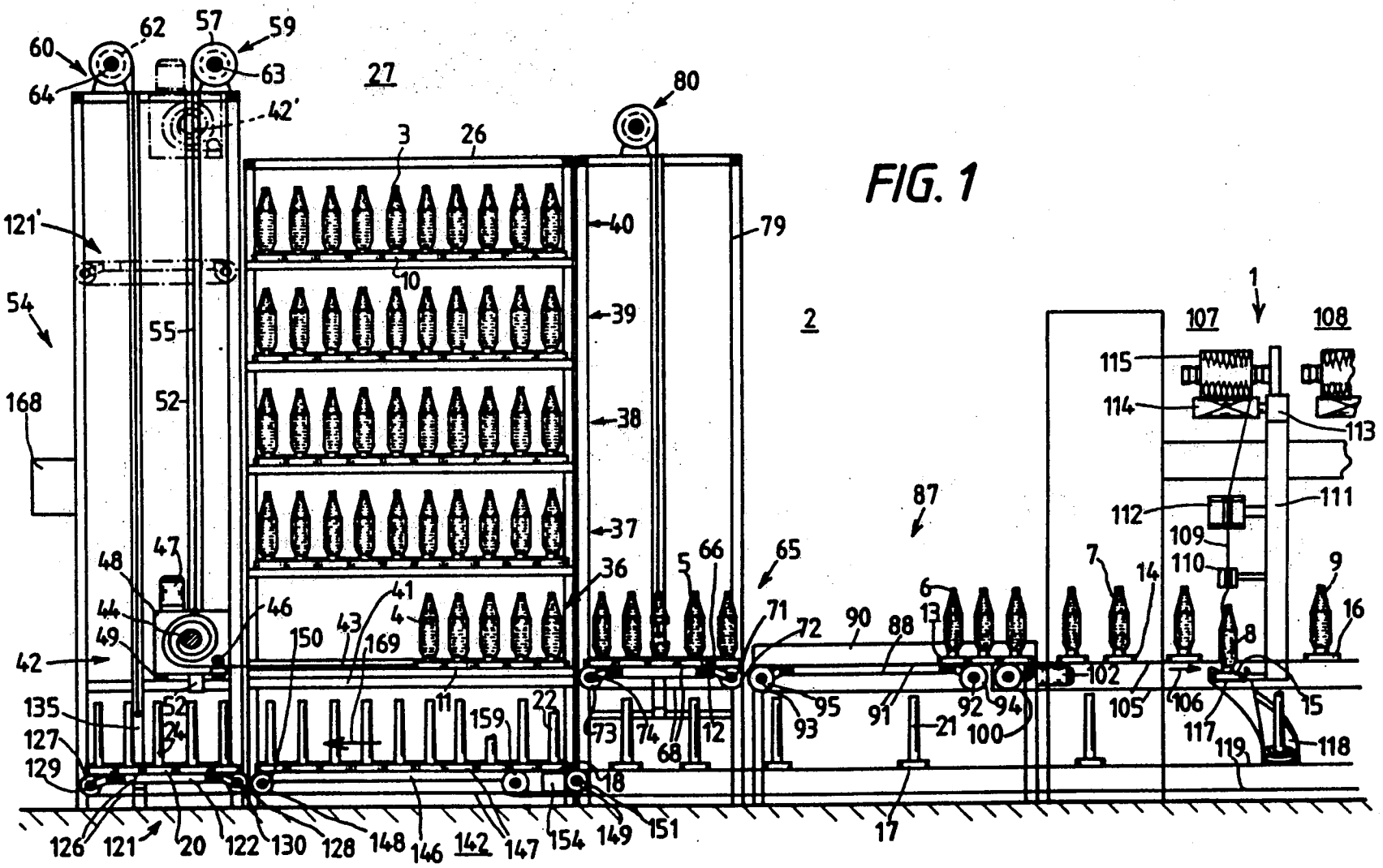
FIG. 1 is a front elevational view of a portion of a textile winding machine and showing one embodiment of the textile tube transport assembly of the present invention operatively disposed with respect to the winding machine.
Figure 2:
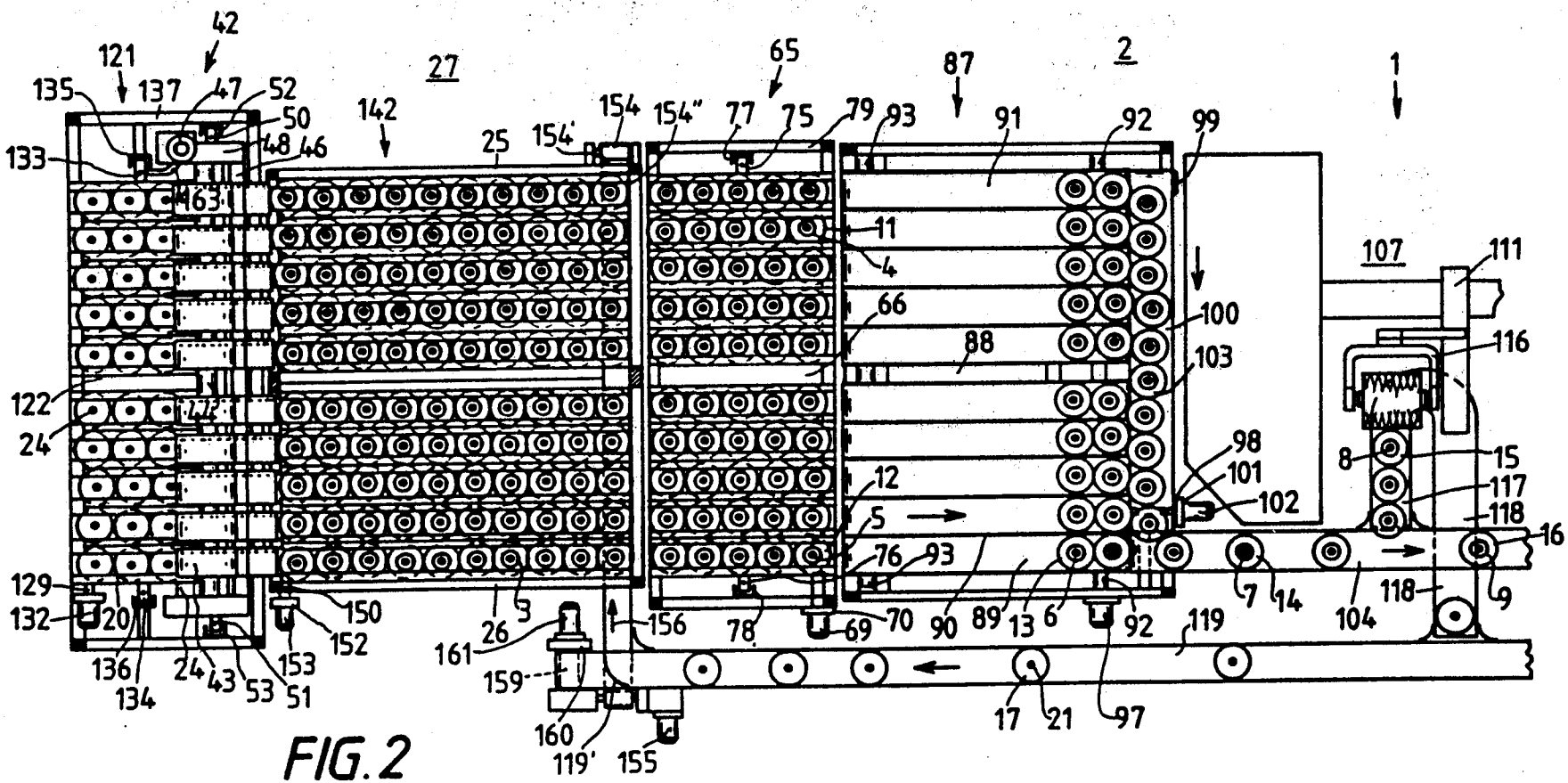
FIG. 2 is a plan view of the portion of the textile winding machine and the one embodiment of the textile tube transport assembly shown in FIG. 1.
Figure 5:
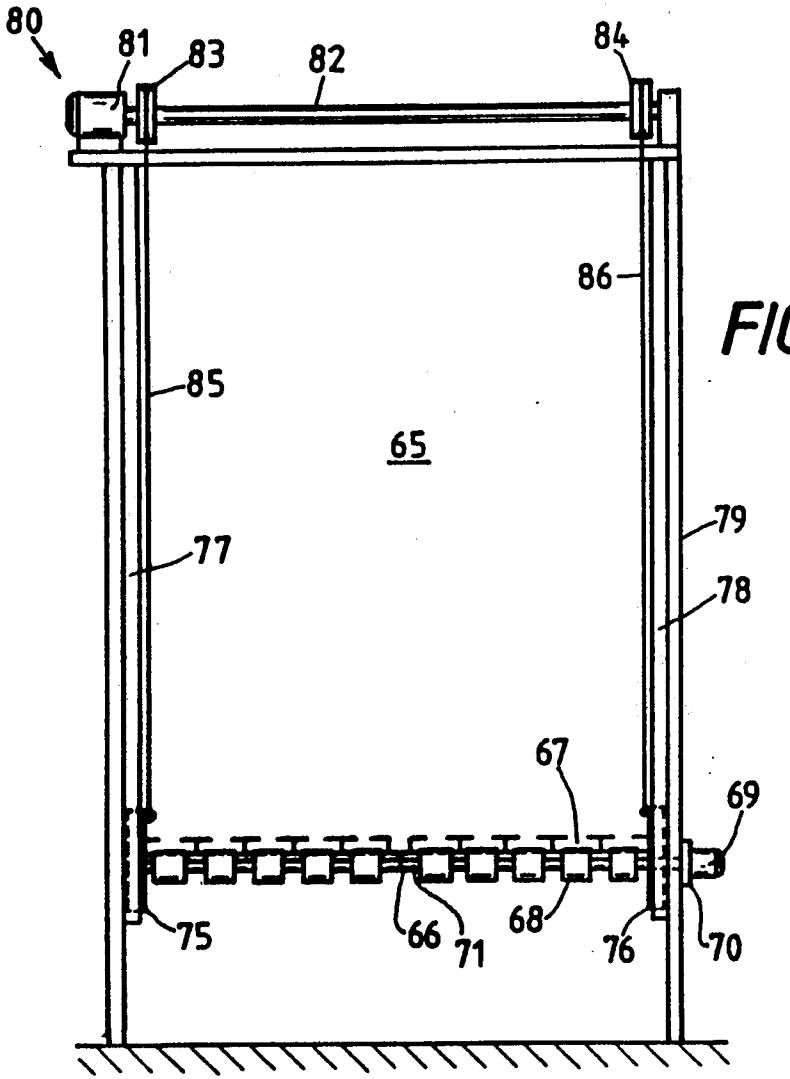
FIG. 5 is a side elevational view of a lift means of the textile tube transport assembly shown in FIG. 1.

As seen in FIG. 1, the incoming travel support means includes a lifting device 65 having a vertically movable horizontal platform member 66 which supports a plurality of selectively actuable endless belt drive components 68 each associated with a respective pair of guide members which define therebetween a tube support guide channel 67, as best seen in FIGS. 1 and 5. The guide channels 67 are formed with guide rails having transverse flange portions in a similar configuration to the guide rails 31,33 of the container portions 25,26 and the guide channels are disposed on the platform member 66 so as to the in alignment with the respective guide channels 28,29 of the containers 25,26 of the respective shelf member 36–40 at which the platform member 66 is disposed.

Each endless belt component 68 includes an endless belt trained around a respective one of a plurality of guide rollers 73, as best seen in FIG. 1, and a respective one of a plurality of drive rollers 72, as best seen in FIG. 1. The drive rollers 72 are commonly mounted on a drive shaft 71 which is drivingly connected to a transmission 70. The transmission 70 is operatively interconnected to a drive motor 69, as best seen in FIG. 5, which is fixedly mounted to the platform member 66 on one side thereof. The drive motor 69 is selectively energizable to drive the endless belts of the endless belt components 68 in a common direction.

The lifting device 65 additionally includes a frame component 79 having a pair of spaced vertical guide members 77,78, as best seen in FIG. 5. The platform member 66 includes a pair of guide roller travelers 75,76 in the form of a cylindrical wheel rotatably mounted to the platform member 66. The guide roller travelers 75,76 are received in guide channels of the vertical guide members 77,78 for guiding of the platform member 66 thereby.

As seen in FIGS. 1 and 5, a horizontally extending top member extends across the top of the vertical guide members 77,78 and is fixedly connected thereto. The horizontal top member supports a platform drive device 80 which includes a drive motor 81 mounted to the horizontal top portion and having a drive shaft 82 and a pair of winding drums 83,84 fixedly mounted to the drive shaft 82 for rotation therewith. The winding drums 83,84 are spaced from one another relative to the axis of the drive shaft 82 and a cable 85,86, respectively, is secured at one end to the winding drums. The other end of the cable 85,86 is connected to the platform member 66.

The platform member 66 is selectively movable in a upward or downward direction to effect positioning of the platform member adjacent a selected one of the shelf members 36–40 of the container portions 25,26 for the subsequent transfer of tube support members between the cross location transport means 27 and the linking means. The upward and downward movement of the platform member 66 is effected through operation of the drive motor 81 to selectively rotate the winding drums 83,84 to wind the cables 85,86 thereon, thereby effecting upward movement of the platform member 66, or to rotate the winding drums 83,84 to effect unwinding of the cables 85,86, thereby effecting lowering of the platform member 66. During the vertical movement of the platform member 66, the guide roller traveler 75,76 guide the platform member 66 along the vertical guide members 77,78 of the frame 79. As seen in FIG. 2, the platform member 66 is operable to receive a full complement of fifty of the tube support members such as, for example, a full complement of fifty of the tube support members 12 each individually supporting a yarn package 5.

Figure 6:
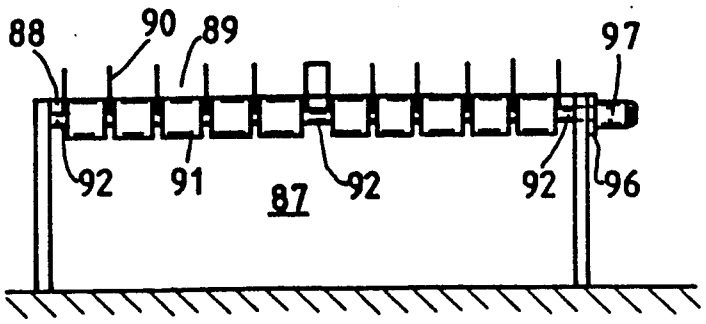
FIG. 6 is a side elevational view of a tube support member accumulating means of the textile tube transport assembly shown in FIG. 1.

The incoming travel support means also includes a reorienting travel means 87, as best seen in FIGS. 1,2 and 6. The reorienting travel means 87 includes a planar, horizontal table member 88 having a plurality of parallel, vertically extending guide walls 90 mounted thereto. Each guide wall 90 is spaced from the adjacent guide wall by a spacing slightly greater than the diameter of the cylindrical base portion of a tube support member and each adjacent pair of the guide walls 90 defines a guide channel 89 for receiving tube support members therein.

Each of the ten guide channels 89 is provided with an endless belt 91 whose top run extends along the top of the table member 88. The endless belts 91 are each trained around one of a plurality of guide rollers 95. The guide rollers 95 ar commonly rotatably mounted on a guide roller shaft 93 which is supported at each end by a frame on which the table member 88 is supported. The endless belts 91 are also each trained around a respective one of a plurality of drive rollers 94 which are commonly fixedly mounted to a drive shaft 92. The drive shaft 92 is rotatably mounted at its free end to the frame supporting the table member 88 and the other end of the drive roller shaft 92 is operatively connected to a transmission 96 which is operatively connected to a drive motor 97 fixedly mounted to the frame supporting the table member 88. The drive motor 97 is energizable to selectively drive the endless belt 91 in a selected direction.

The table member 88 is supported at the same height as the lowermost shelf member 36 of the container portions 25,26 and the guide channels 89 are aligned with the respective guide channels 28,29 of the container portions 25,26.

As best seen in FIG. 2, the reorienting, travel means 87 also includes a transverse movement means in the form of an endless belt 100 trained around a guide roller 99 rotatably mounted to the frame supporting the table member 88 and a drive roller 98. The drive roller 98 is operatively connected to a transmission 101 which is itself operatively connected to a drive motor 102. The drive motor 102 is fixedly mounted to the frame supporting the table member 88 and is selectively energizable to drive the endless belt 100 in a direction transverse to the direction of the movement of the endless belts 91.

As seen in FIG. 2, the endless belt 100 extends transversely adjacent nine of the ten guide channels 89 but does not extend transversely adjacent a selected one of the pair of the outermost guide channels 89. The endless belt 100 and the selected outermost guide channel 89 are operable to transport tube support members to an ongoing transfer means associated with the automatic textile winding machine 1. The ongoing transfer means includes an endless belt 105 forming a yarn package delivery path 104 which extends adjacent the selected outermost guide channel 89 and adjacent one end of the endless belt 100 for receiving tube support members delivered thereto by the endless belt 100 and the endless belt 91 associated with the selected outermost guide channel 89. For example, the endless belt 105, whose top run moves in the direction indicated by the arrow 106 in FIG. 1, is operable to receive a tube support member such as, for example, a tube support member 103, which is supported on the endless belt 100 and to receive a tube support member from the selected outermost guide channel 89 such as, for example, a tube support member 13 on which a yarn package 6 is supported, for further transport of the tube support members 13,103 to the winding stations of the automatic textile winding machine 1 for winding of the yarn packages thereat.

Each of the winding stations of the automatic winding machine 1 are identically configured. For example, as seen in FIG. 1, a winding station 107 includes a frame 111 on which a cross wound package spindle 116 is mounted for supporting a cross wound package 115. Yarn is fed from a yarn package such as, for example, a yarn package 8 supported on a tube support member 15 to a transverse winding drum 114 which is operatively interconnected to a winding drive motor 113 mounted on the frame 111 for transversely winding the yarn onto the cross wound package 115. The yarn 109 traveling from the yarn package 8 travels through a yarn brake 110 mounted to the frame 111 and a conventional slough catcher 112 mounted to the frame 111.

Each of the winding stations includes a slide component 117, as best seen in FIGS. 1 and 2. The slide component 117 includes a relatively slightly downwardly inclined linear portion at its upper end which extends from a location adjacent the endless belt 105 to the unwinding location at which the respective tube support member is held during unwinding of the yarn package supported thereon. For example, as seen in FIG. 2, the slightly inclined linear portion of the slide component 117 is operable to randomly receive a tube support member such as, for example, the tube support member 15, as the tube support members are transported along the winding machine delivery path 104 and the slightly inclined linear portion of the slide component has a capacity to support two tube support members in a ready position for subsequent sliding movement into the yarn package unwinding location.

The slide component 117 also includes a generally U-shaped portion extending from the slightly inclined linear portion thereof and a linearly extending exit portion 118 which extends at an incline from the U-shaped curved portion. As the yarn package supported at the yarn package winding location is completely unwound, the tube support member, which now supports the empty tube on which the yarn package was previously built, is released from the yarn package winding location to slide further along the slide component 117 through the U-shaped portion and along the exit portion 118. The exit portion 118, as best seen in FIG. 1, extends at an incline sufficiently below the endless belt 105 to permit the empty tubes supported on the tube members sliding therealong to pass without interference underneath the endless belt 105.

The linking means also includes an outgoing travel support means for supporting a plurality of tube support members which have been transferred thereto from the textile machine associated with the respective exchange location at which the cross location transport means 27 is located for supporting the tube support members during travel thereacross to the cross location transport means 27. The outgoing travel support means includes an endless belt such as, for example, the endless belt 119 shown in FIGS. 1 and 2, which extends adjacent the respective textile machine for receiving the tube support members therefrom after handling of the tube or yarn package, respectively, supported on the tube support member by the respective textile machine. For example, the endless belt 119 extends parallel to the endless belt 105 of the winding machine delivery path 104 adjacent the end of the plurality of the slide components 117 for receiving the tube support members exiting therefrom on which the empty tubes are supported. The endless belt 119 is trained around a drive roller 159 which is fixedly mounted to a drive shaft of a transmission 160. The transmission 160 is operatively interconnected to a drive motor 161 for driving operation of the endless belt 119 to move the belt in the direction indicated by the arrow shown in FIG. 2. As also seen in FIG. 2, the outgoing travel support means includes an endless belt 154 trained around a guide roller 158 and a drive roller 157, as best seen in FIG. 3. The drive roller 157 is operatively interconnected to a drive motor 155 for driving operation of the belt 154 in a direction transverse to the direction of movement of the endless belt 119. The upper run of the endless belt 154 extends in intersecting relation with the upper run of the endless belt 119 and a curved guide member 119' is fixedly mounted at the intersecting location for guiding tube support members from the endless belt 119 onto the endless belt 154 for movement by the endless belt 154 in the direction shown by the arrow 156 in FIG. 2.

The endless belt 154, whose width dimension transverse to its direction of travel is less than the diameter of the base portion of a tube support member, extends adjacent a stationary collecting station 142 which, as seen in FIGS. 1 and 2, includes a plurality of guide channels 143 having a combined capacity to temporarily store one hundred tube support members. Each guide channel 143 is adapted to receive a plurality of tube support members for guiding of the tube support members along a row in the direction indicated by the arrow 169 in FIG. 1. The guide channels 143 extend parallel to one another. A selectively operable stop member (not shown) is disposed at the end of the travel paths of the guide channels 143 to prevent further travel therepast of the tube support member.

As seen in FIG. 2, at the end of the upper run of the endless belt 154, a stop member 154' is positioned for preventing further travel therepast of the tube support members supported on the endless belt. A lateral stop member 154" extends along one lateral side of the endless belt 154 to prevent movement of the tube support members supported on the endless belt laterally beyond the endless belt.

As seen in FIG. 1, the stationary collecting member 142 includes a planar, horizontally extending table member 146 on which a plurality of parallel, vertically extending guide rails 145 are mounted. As seen in FIG. 3, each guide rail 145 includes a flange portion 144 extending transversely therefrom and each adjacent pair of the flange portions 144 forms an opening therebetween for receiving the neck portion of a tube support member therebetween for guiding of the tube support member. Each adjacent pair of the guide rails 145 forms one of the guide channels 143.

A respective one of the plurality of endless belts 147 extends along each guide channel 143 with its upper run supported on the table member 146. As seen in FIGS. 1-3, each endless member 147 is trained around a respective one of a plurality of drive rollers 148 which are commonly fixedly mounted to a drive roller shaft 150 rotatably supported on the table member 146. Additionally, each endless belt 147 is trained around a respective one of a plurality of guide rollers 149 which are commonly rotatably mounted on a guide roller shaft 151. The guide roller shaft 151 is mounted to the table member 146. The drive roller shaft 150 is operatively interconnected to a transmission 152 which is operatively interconnected to a drive motor 153, as best seen in FIG. 3, for driving rotation of the endless members 147 in a common direction in which the tube support members are guided along the guide channels 143 in the direction shown by the arrow 169 in FIG. 1.

The stationary tube collecting member 142 is operable to receive the tube support members transported along the endless belt 154 to temporarily store the tube support members prior to loading of the tube support members onto the cross location transport means 27. The guide channels 143 of the stationary collection member 142 are operable to receive the tube support members from the endless belt 154 and to guide the tube support members in a plurality of aligned rows.

Figure 4:
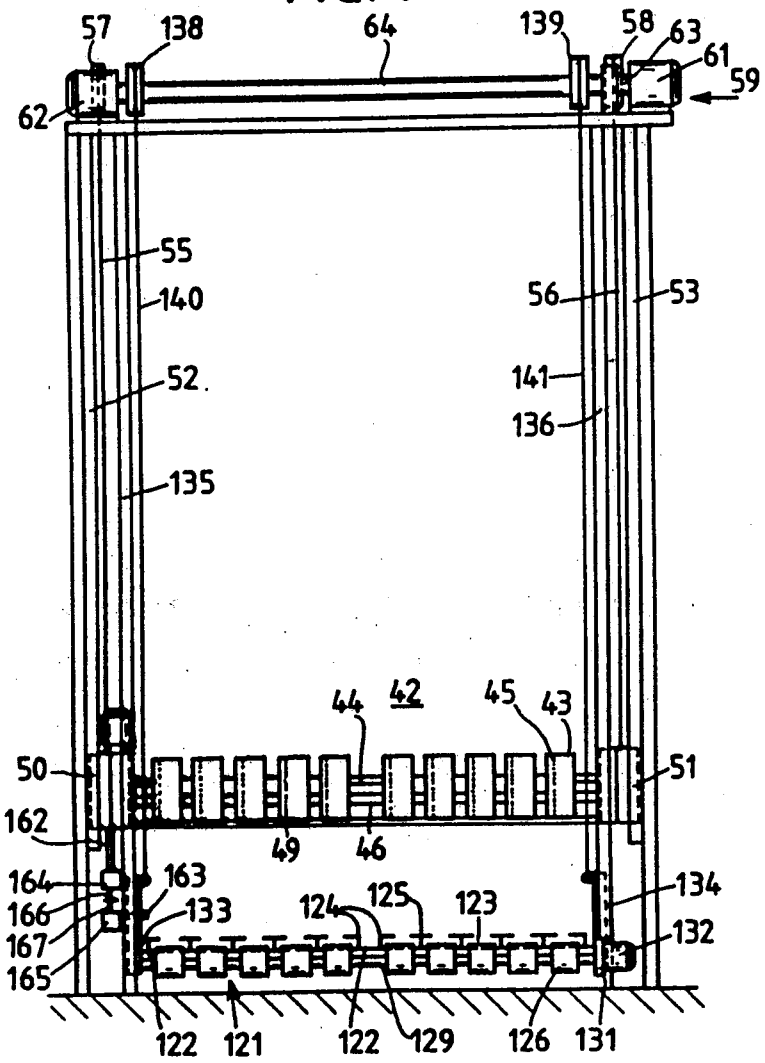
FIG. 4 is an opposite side elevational view of a portion of the textile tube transport assembly shown in FIG. 1.

The outgoing travel support means also includes a loading device 54 for loading of the tube support members stored in the stationary collection member 142 onto the cross location transport means 27. The loading device 54 includes a lifting component 121 which, as best seen in FIGS. 1,2 and 4, includes a planar platform member 122 having a plurality of parallel, vertically extending guide rails 124 mounted at uniform spacings therealong. Each guide rail 124 includes a flange portion 125 extending transversely therefrom and each adjacent pair of the flange portions 125 defines an opening therebetween for receiving the neck portion of a tube support member for guiding of the tube support member therebetween. Each adjacent pair of the guide rails 124 forms a guide channel 123 and the guide channels 123 are arranged in alignment with the guide channels 143 of the stationary collection member 142. The upper run of a respective one of a plurality of endless belts 126 extends along each guide channel 123 and is supported on the table member 122. As seen in FIG. 1, each endless belt 126 is trained around a respective one of a plurality of guide rollers 127 which are commonly rotatably mounted on a guide roller shaft 129. Additionally, each endless belt 126 is trained around a respective one of a plurality of drive rollers 128 which are commonly fixedly mounted to a drive roller shaft 130. The guide roller shaft 129 and the drive roller shaft 130 are mounted to the table member 122.

As seen in FIG. 4, the drive roller shaft 129 is operatively interconnected to a transmission 131 which is operatively interconnected to a drive motor 132. The drive motor 132 is mounted to the table member 122. The drive motor 132 is selectively energizable to commonly drive the endless belts 126 in a common drive direction.

As seen in FIGS. 2 and 4, a guide roller traveler 133,134 is mounted at a respective side of the table member 122 and is in the form of a cylindrical guide wheel. The lifting component 121 includes a frame 137 having a pair of spaced, parallel vertical guide members 135,136 each of which has a guide channel for receiving a respective one of the guide roller travelers 133,134 therein for guiding of the table member 122 during its vertical movement.

A horizontally extending top member is mounted to the tops of the vertical guide members 135,136 and, as best seen in FIG. 4, the lift component 121 includes a power drive assembly 60 having a drive motor 62 mounted to the horizontal top member. The drive motor 62 includes a drive shaft 64 on which a pair of winding drums 138,139 are fixedly mounted in spaced relation to one another relative to the axis of the drive shaft 62. One end of a cable 140,141 is secured to the winding drum 138,139, respectively, and the other end of the cable is secured to the table member 122. The power drive assembly 60 is operable to selectively raise and lower the table member 122. To effect raising of the table member 122, the drive motor 62 rotates the winding drums 138,139 to effect winding of the cables 140,141 thereon. To effect lowering of the table member 122, the drive motor 62 rotates the winding drums 138,139 to effect unwinding of the cables 140,141 therefrom. During its vertical movement, the table member 122 is guided relative to the vertical guide members 135,136 by the guide roller travelers 51,52.

The outgoing travel support means also includes a displacing means 42 which is operable to displace tube support members from the container portions 25,26 onto the lifting device 65. The displacing means 42 includes, as seen in FIGS. 1 and 4, a plurality of pushing means in the form of a plurality of selectively coilable and uncoilable steel bands 43. The steel bands 43 are fixedly secured at one end to a common drive shaft 44 and are selectively coilable and uncoilable about the drive shaft 44 in response to rotation of the drive shaft. Each steel band includes a plurality of perforations 45 configured for meshing engagement with a respective one of a plurality of gears 46. The gears 46 are commonly mounted to a gear drive shaft which is operatively interconnected to a transmission 48. The transmission 48 and the drive shaft 44 are operatively interconnected to a drive motor 47.

The drive motor 47 is selectively energizable to effect coordinated rotation of the gears 46 and coiling or uncoiling rotation of the drive shaft 44 to thereby selectively effect coiling or uncoiling of the steel bands 43. The gears 46 engage the perforations 45 to drive the steel bands 43 outwardly in coordination with the uncoiling movement of the drive shaft 44 and inwardly in coordination with the coiling movement of the drive shaft 44.

The drive motor 47, the drive shaft 44, the gears 46 and the steel bands 43 are mounted on a platform member 49 having a guide roller element 50,51 mounted at each respective end thereof. The guide roller travelers 50,51 are received in the vertical channels of a pair of vertically extending support members 52,53, as seen in FIG. 4, for guiding of the platform member 49 as it is raised and lowered. A displacing means lifting component 59 includes a drive motor 57 mounted to the top member mounted to the tops of the vertical guide members 135,136. As seen in FIG. 4, the drive motor 59 includes a drive shaft 63 on which a pair of winding drums 57,58 are fixedly mounted in spaced relation to one another. One end of a cable 55,56 is fixedly mounted to the winding drum 57,58, respectively, and the other end of the cable 55,56 is mounted to the platform member 49 adjacent a respective end thereof.

As seen in FIG. 4, an extension member 162 extends downwardly from the guide roller traveler 50 and includes a limit switch 164 at its lower free end. The guide roller traveler 133 mounted to the table member 122 includes an upright carrier 163 having a limit switch 165 mounted on its free end. Each limit switch 164,165 includes an actuating lever 166,167, respectively, and the two actuating switches are disposed in vertical alignment with one another so that the actuating switches engage one another when the platformed member 49 and the table member 122 have been vertically moved toward one another within a predetermined range.

In response to the engagement of the actuating levers 166,167 with one another, the drive motor 61 is controlled to immediately stop and, thereafter, to rotate the winding drums 57,58 only in a winding direction by which the platform member 49 is raised and the drive motor 62 is controlled to immediately stop and, thereafter, to rotate the winding drums 138,139 only in the unwinding direction so that the table member 122 is lowered. The controlled movement of the drive motor 61,62 is initiated only when the drive motors are actuated.

The transport assembly illustrated in FIGS. 1–6, operates as follows. The container portions 25,26 are loaded with a complement of tube support members supporting yarn packages at the spinning machine exchange location (not shown) in the manner in which the neck portion of each tube support member is received in the opening formed by the flange portions 30,32 of each guide channel 28,29. For example, as seen in FIG. 1, the plurality of tube support members 10 individually supporting the yarn packages 3 thereon, are loaded in the guide channel 29 of the container portion 26 on each of the shelf members 36–40. The container portions 25,26 of the cross location transport means 27 are then transported from the spinning machine exchange location to the winding machine exchange location. In this regard, any appropriate conventional means for transporting a loaded container from one location to another can be used. For example, each container portion 25,26 can be provided with vertically extending legs which extend below the bottom portion 41 for supporting the container portions at a spacing above the floor. The spacing could permit the insertion of the tines of the fork of forklift-type tractor which can then operate to lift and lower the container portions 25,26 relative to the floor.

Once the container portions 25,26 have been transported to the winding machine exchange location and disposed in the disposition shown in FIG. 1, the unloading of the tube support members 10 from the cross location transport means 27 proceeds as follows. The displacement means 42 is positioned as shown in FIG. 1 in its disposition for displacing the tube support members from the lowermost shelf member 36 of the container portions 25,26 and the platform 66 of the lifting component 65 is also aligned with the lowermost shelf member 36. In response to the signal from a conventional sensing means (not shown) which senses the presence of the container portions 25,26 at the winding machine exchange location, a control unit 168, which is schematically shown in FIG. 1 and can be, for example, a conventional computer, controls the drive motor 51 to effect unwinding of the steel bands 43.

As seen in FIG. 1, the rotation of the gears 46 in a counter-clockwise direction, in coordination with the counter-clockwise rotation of the shaft 44, effects unwinding of the steel bands 43 and the steel bands 43 are extended along the guide channels 28,29 of the container portions 25,26 to thereby displace the tube support members in the guide channels onto the guide channels 67 of the platform member 66. As the tube support members are displaced beyond the guide channels 67 of the platform member 66, they enter the aligned guide channels 89 of the reorienting travel means 87. For example, as seen in FIG. the tube support members 11 which support the yarn packages 4 thereon, are displaced by the steel bands 43 onto the guide channels 67 of the platform member 66 and the tube support members on the platform member 66, as representatively shown by the tube support member 12 supporting a yarn package 5, are displaced onto the guide channels 89 of the reorienting travel means 87, as representatively shown by the tube support member 13 supporting a yarn package 6 thereon.

Once the guide channels 28,29 of the lowermost shelf member 36 have been completely emptied of the tube support members supported therein through the action of the steel bands 43, the control unit 168 controls the drive motor 51 to effect coiling of the steel bands 43. In coordination with the coiling of the steel bands 43, the control unit 168 controls the drive motor 81 to effect raising of the platform member 6 into vertical alignment with the next lowermost shelf member 37 of the container portions 25,26.

Once the steel bands 43 have been completely returned to their fully-coiled positions, the control unit 168 controls the drive motor 61 to effect raising of the displacement means 42 into alignment with the next lowermost shelf member 37 such that the steel bands 43 are displaceable along the guide channels 28,29 of the shelf member. As the displacing means 42 is raised, the actuator lever 166 of its limit switch 164 moves out of engagement with the actuating lever 167 of the limit switch 165, thereby effecting cessation of the controlled movement of the platform member 122. The platform member 122 can now be raised through energization of the drive motor 62 and the control 168 controls the upward movement of the platform member 122 to bring the platform member into vertical alignment with the lowermost shelf member 36 of the container portions 25,26 for unloading of the tube support members 20 having empty tubes 24 thereon from the platform member 122 onto the shelf member 36. The platform member 122 had previously been loaded with the tube support members 20 in a winding machine unloading operation described in more detail below.

In correspondence with the movement of the displacement means 42 and the platform member 66 into vertical alignment with the next lowermost shelf member 37, the control unit 168 controls the drive motor 51 to effect uncoiling of the steel bands 43. the steel bands 43 displace the tube support members supported in the guide channels 28,29 of the shelf member 37 onto the guide channels 67 of the platform member 66. In the event that the platform member 66 has a smaller capacity than the shelf member 37, the control unit 168 stops the displacement of the steel bands 43 once the platform member 66 has been fully loaded. For example, as seen in FIG. 1, the shelf member 37 can be configured to support a total of ten tube support members along each guide channel 28,29 whereas the platform member 66 only has the capacity to support five tube support members in each of its guide channels 67. In this event, the control unit 168 stops the movement of the steel bands 43 after the first set of five tube support members have been displaced from the shelf member 37 to the platform member 66. After the platform member 66 is fully loaded, the control unit 168 controls the drive motor 81 to effect lowering of the platform member 66 to a position in which it is again vertically aligned with the reorienting travel means 87. The control unit 168 then controls the drive motor 69 to effect travel of the endless members 68 in a direction which effects transfer of the tube support members from the guide channels 6 of the platform member 66 into the aligned guide channels 89 of the reorienting travel means 87. Once the tube support members have been fully unloaded from the platform member 66, the control unit 168 controls the drive motor 81 to raise the member 66 into vertical alignment with the shelf member 37 for receiving the second set of five tube support members from each guide channel 28,29 of the container portions 25,26.

In correspondence with the movement of the displacing means 42 into alignment with the next lowermost shelf member 37, the control unit 168 controls the drive motor 62 to effect the raising of the platform member 122 into vertical alignment with the lowermost shelf member 36. Thereafter, the control unit 168 controls the drive motor 132 to effect movement of the endless belts 126 in a direction in which the tube support members 20 supported on the platform member 122 are transferred into the guide channels 28,26 of the shelf member 36.

After the platform 122 has been completely unloaded, the control unit 168 controls the drive motor 62 to effect lowering of the platform member 122 to its lowermost position in alignment with the stationary collecting means 142 for receiving additional tube support members therefrom. In correspondence with the return of the platform member 122 to its lowermost vertical position, the drive motor 153 of the stationary collection means 142 is controlled to drive the endless belts 147 in the direction indicated by the arrow 169 in FIG. 1 to effect movement of the tube support members from the guide channels 143 of the stationary collection means 142 into the aligned guide channels 123 of the platform member 122. The drive motor 132 is operated in coordination with the operation of the drive motor 153 to move the endless belts 126 in the direction of travel indicated by the arrow 169 in FIG. 1 to effect complete loading of tube support members onto the platform members 122. The platform member 122 is provided with appropriate conventional stop means (not shown) at the ends of the guide channels 123 opposite the end of the platform member 122 which is adjacent the stationary collection means 142. The stop means prevent further travel of the tube support members loaded onto the endless belts 126. Alternatively, the platform member 122 can be provided with conventional sensors (not shown) which count the tube support members loaded thereon and provide a signal to the control unit 168 to cease loading of the platform member 122 once a predetermined number of tube support members have been loaded thereon.

After the platform member 122 has been loaded with a further complement of the tube support members, the control unit 168 controls the drive motor 62 to effect raising of the platform member 122 to the appropriate shelf member 36–40 to which the tube support members will be off-loaded.

The drive motor 97 of the reorienting travel means 87 is controlled to constantly operate to drive the endless belts 91 in the direction in which the tube support members are continuously moved toward and onto the endless belt 100. Additionally, the drive motor 102 is controlled to continuously operate to drive the endless belt 100 in a direction in which the tube support members thereon are moved towards and onto the endless belt 105. The tube support members transported by the endless belt 100 are transported in a direction transverse to the direction of movement of the endless belts 91. Thus, the reorienting travel means 87 is operable to reorient the multiple, parallel directions of travel of the tube support members along the guide channels 91 into a single direction of travel along the endless member 105 for feeding to the winding stations of the winding machine 1.

As each yarn package is completely unwound at a winding station of the automatic winding machine 1, the now empty tube on which the yarn package was previously built, and the tube support member which supports the tube in an upright disposition, travels down the slide component 117 onto the endless belt 119 for transport to the stationary collection means 142. As seen in FIG. 2, for example, a tube support member 17 having an empty tube 21 supported thereon, is transported along the endless belt 119 and, as the tube support member enters the intersecting location of the endless belt 119,154, the guide member 119' guides the tube support member 17 onto the endless belt 154. The endless belt 154 is continuously operated to move the tube support members into engagement with the endless belts 147 of the stationary collection means 142. Since the width of the endless belt 154 is less than the diameter of the tube support member, the endless belts 147 operate to continuously remove the tube support members from the endless belt 154 and advance these tube support members in the direction shown by the arrow 169 in FIG. 1. To conserve space, the stationary collection means 142 can be disposed relative to the winding machine exchange location such that the container portions 25,26 are located above the stationary collection means.

After each of the shelf members 36–40 have been completely unloaded of the tube support members supporting yarn packages and have been completely loaded with tube support members supporting empty tubes, the displacement means 42 is raised to the position indicated by the broken lines 42' in FIG. 1. This uppermost raised position of the displacement means 42 permits movement of the platform member 122 into the position shown by the broken lines 121' in FIG. 1 for the loading of tube support members onto the uppermost shelf member 40.

Once the uppermost shelf member 40 has been loaded with its complement of tube support members having empty tubes thereon, the container portions 25,26 are transported from the winding machine exchange location to the spinning machine exchange location for unloading of the tube support members thereat. If the spinning machine exchange location is provided with linking means, incoming travel support, outgoing travel support means and ongoing transfer means similar to those provided at the winding machine exchange location, the unloading of the tube support members supporting empty tubes thereon and the loading of tube support members having yarn packages thereon onto the container portions 25,26 occurs in a similar manner as the operation described above. Once the container portions 25,26 have again received a new complement of tube support members supporting yarn packages, the container portions 25,26 are again transported from the spinning machine exchange location to the winding machine exchange location for another loading and unloading cycle.

Figure 7:
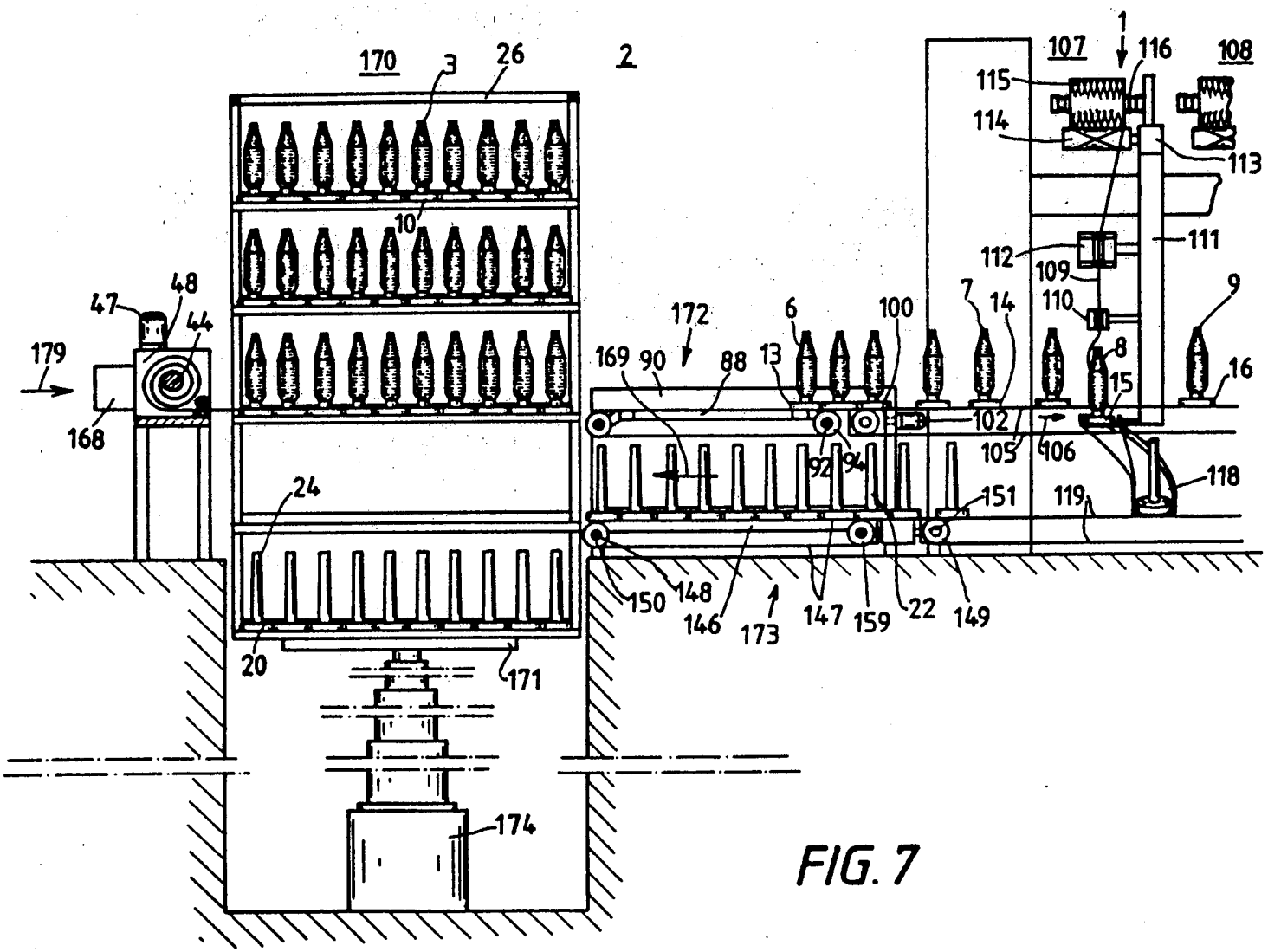
FIG. 7 is a front elevational view of a textile winding machine and showing another embodiment of the textile tube transport assembly of the present invention.

In FIG. 7, another embodiment of the transport assembly of the present invention is illustrated in its operative disposition relative to the automatic textile winding machine 1. The transport assembly includes a cross location transport means 170 having a container portion 23 with a plurality of parallel, vertically spaced shelves. The container portion 26 is disposable on a planar lifting table 171 which is mounted at the winding machine exchange location. The lifting table 171 is fixedly mounted to a lifting device 174 which can be in the form, for example, of a telescoping hydraulic or pneumatic cylinder operable to raise and lower the lifting table 171 by a predetermined amount.

The transport assembly also includes an incoming travel support means 172 and an outgoing travel support means 173. The incoming travel support means 172 is identically configured to the reorienting travel means 87 and includes a plurality of endless belts 88, a plurality of guide members 90, an endless belt 100 and the drive motors 94 and 102. The incoming travel support means 172 is operable to receive tube support members transferred thereto from the container portion 26 and to transfer the tube support members to the endless belt 105 for further transport to the winding stations of the automatic textile winding machine 1.

The outgoing travel support means 173 is identically configured to the stationary collecting means 142 and is operable to receive tube support members from the endless belt 119 having empty tubes supported thereon. The outgoing travel support means 173 is operable to transfer the tube support members supported thereon to the shelf members of the container portion 26.

In the embodiment of the transport assembly shown in FIG. 7, a displacing means similar to the displacing means 42 of the embodiment illustrated in FIGS. 1–6 is provided for displacing the tube support members from the container portion 26 onto the incoming travel support means 172. The displacing means 179 includes the steel band arrangement such as discussed with respect to the displacing means 42 except that the drive motor 51 is not vertically displaceable but is, instead, mounted at a fixed height on a pair of support legs such that the steel bands 43 are operable to displace the tube support members of the respective shelf member which is aligned with the incoming travel support means 172. The control unit 168 is also mounted to the support stand which supports the displacing means 179.

In operation, the control unit 168 controls the lifting device 174 to raise the lifting table 171 to its uppermost position in which the lowermost shelf member of the container portions 25,26 supported on the lifting table 171 will be in alignment with the steel bands 43. The control unit 168 then controls the movement of the steel bands 43 to effect displacement of the tube support members from the lowermost shelf member of the container portions 25,26 onto the incoming travel support means 172. The displaced tube support members are then further transported to the endless belt 105 for transport to the winding stations of the automatic textile winding machine 1. After the lowermost shelf member of the container portions 25,26 has been emptied of tube support members, the control unit 168 controls the lifting device 174 to lower the container portions 25,26 so that the next lowermost shelf member of the container portions is moved into alignment with the steel bands 43. In correspondence with the displacement of the tube support members from the next lowermost shelf member of the container portions 25,26 onto the incoming travel support means 172, the outgoing travel support means 173 is operated to load tube support members onto the lowermost shelf member of the container portions, which is now in alignment with the outgoing travel support means.

The operation of the transport assembly proceeds in a manner in which the lifting device 174 is operated to lower the container portions 25,26 during each cycle by an amount corresponding to the vertical spacing between an adjacent pair of the shelf members of the container portions so that each successive, next higher shelf member is unloaded of its tube support members having yarn packages supported thereon and the shelf member immediately therebelow is loaded with tube support members having empty tubes supported thereon.

In FIGS. 8 and 9, a further embodiment of the transport assembly of the present invention is illustrated. The transport assembly includes the lifting table 171 and the lifting device 174 discussed with respect to the embodiment shown in FIG. 7. Additionally, the transport assembly includes an incoming travel support means 180 and an outgoing travel support means 181. The incoming travel support means 180 includes an endless belt 175 trained around a drive roller which is operatively connected to a drive motor 183. The endless belt 175 is aligned with the endless belt 119 for receiving tube support members having empty tubes supported thereon from the automatic textile winding machine 1. A displacement means 176 includes an elongate member extending parallel to the direction of movement of the endless belt 175 and a drive device for selectively moving the elongate member in a direction transverse to the direction of movement of the endless belt 175. The drive device is operatively connected via a connector 185' to a counting device 185. A counting sensor 184 is positioned adjacent the travel path of the endless belt 175 at a location upstream of the elongate member and the counting sensor 184 is operatively connected to the counting device 185. A stop bar 175' extends transversely across the travel direction of the endless belt 175 at a location downstream of the elongate member.

The outgoing travel support means 181 includes an endless belt 177 operable to transport tube support members having yarn packages thereon to the endless belt 105 for subsequent delivery to the winding stations of the automatic textile winding machine 1. The endless belt 177 is driven by a drive motor 182. A lateral stop member 178 extends parallel to the direction of the travel of the endless member 177. A stop member 177' extends transversely across the travel path of the endless belt 177.

In operation, the container portions 25,26 are disposed on the lifting table 171 and the lifting device 174 is operated to dispose the lowermost shelf member of the container portions at a height in which it is in alignment with the upper runs of the endless belts 175,177. The guide channels 28,29 of the container portions 25,26 extends transversely with respect to the direction of travel of the endless belts 175,177. As tube support members supporting empty tubes thereon are transported by the endless belts 175 toward the end of its travel path, each successive tube support member is transported past the counting sensor 184 which counts the passage therepast of the tube support member and provides a signal to the counting device 185. When the counting device 185 determines that a predetermined number of tube support members have been transported past the counting sensor 184 which corresponds to the number of guide channels 28,29 of the container portions 25,26, the counting device 185 sends a signal via the connector 185' to the drive device of the displacement means 176.

In response to the receipt of the signal from the counting device 185, the displacement device 176 extends its elongate member transversely across the travel path of the endless belt 175 to push the tube support members supporting empty tubes thereon from the endless belt 175 onto the guide channels 28,29 of the container portions 25,26. This movement of the tube support members produces corresponding unloading of an equal number of tube support members from the opposite ends of the guide channels 28,29 onto the endless belt 177. The lateral stop member 178 prevents these displaced tube support members being loaded onto the endless belt 177 from traveling laterally beyond the endless belt. The tube support members thus loaded onto the endless belt 177 are transported to the endless belt 105 for further delivery to the winding stations of the winding machine.

After a subsequent group of tube support members have again been collected adjacent the elongate member of the displacement device 176, the counting device 185 again sends a signal to the displacement device 176 to push the subsequently collected group of tube support members onto the guide channels 28,29 of the container portions 25,26. The loading and unloading of the container portions 25,26 continues in like manner until the container portions have been fully loaded with tube support members supporting empty tubes thereon and all of the tube support members having yarn packages supported thereon have been transferred to the endless belt 177. As each successive shelf member of the container portions 25,26 has been unloaded, the lifting device 174 is operated to effect lowering of the container portions 25,26 to bring the next higher shelf member into vertical alignment with the incoming travel support means 180 and the outgoing travel support means 181.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile production system in which a textile spinning machine is operable to build yarn packages on tubes which are individually supported on tube support members and a textile winding machine having a plurality of winding stations each for winding yarn packages, a transport assembly for delivering tube support members having yarn packages supported thereon from the textile spinning machine to the textile winding machine and for returning tube support members having empty tubes supported thereon from the textile winding machine to the textile spinning machine, comprising:

cross location transport means for supporting a plurality of tube support members for groupwise transport thereof between a spinning machine exchange location associated with the spinning machine and a winding machine exchange location associated with the winding machine, said cross location transport means being movable between, and disposable at, each of said exchange locations for the transfer of tube support members between said cross location transport means and the respective textile machine associated with the exchange location and said cross location transport means including first shelf means for supporting a first group of tube support members and second shelf means for supporting a second group of tube support members, said first and second shelf means being disposed at different heights from one another; and linking means, associated with at least one of the textile machines, for supporting tube support members during travel thereof between said cross location transport means and said at least one textile machine, said linking means including incoming travel support means for supporting a plurality of tube support members which have been transferred thereto from said cross location transport means during travel thereacross of the tube support members to said respective textile machine and outgoing travel support means for supporting a plurality of tube support members which have been transferred thereto from said respective textile machine for travel thereacross to said cross location transport means, said incoming and outgoing travel support means each being operable to support tube support members thereon independently of the other said travel support means and said outgoing travel support means being at a different height than at least one of said first and second shelf means and including an outgoing height differential transfer means for transferring tube support members from said outgoing travel support means to said first and second shelf means and said incoming travel support means being at a different height than at least one of said first and second shelf means and including an incoming height differential transfer means for transferring tube support members from said first and second shelf means to said incoming travel support means, said incoming height differential transfer means including means for advancing tube support members out of the first shelf means independent of the introduction of other tube support members onto the first shelf means and contemporaneous with the introduction of tube support members into the second shelf means by said outgoing height differential transfer means, whereby the unloading of tube support members from the first shelf means proceeds independently of the availability of tube support members for loading onto said cross location transport means by said outgoing travel support means.

2. In a textile production system, the transport assembly according to claim 1 wherein said at least one textile machine is the textile winding machine and the textile winding machine includes a linearly extending delivery path for delivering tube support members received from said incoming travel support means to the winding stations of the textile winding machine, the tube support members supported by the linearly extending delivery path being arranged in a single file arrangement and characterized further in that said incoming travel support means includes means for supporting tube support members in an arrangement in which at least some of the tube support members are supported in offset relation to the linearly extending delivery path following the transfer of said tube support members from said cross location transport means to said incoming travel support means and aligning feed means for feeding the tube support members from said incoming travel support means to the linearly extending delivery path.

3. In a textile production system, the transport assembly according to claim 1 and characterized further in that said cross location transport means includes first shelf means for supporting a first group of tube support members and second shelf means for supporting a second group of tube support members, said first and second shelf means being disposed at different heights.

4. In a textile production system, the transport assembly according to claim 3 and characterized further in that said outgoing travel support means includes means for selectively lifting tube support members to said first shelf means and selectively lifting tube support members to said second shelf means and said incoming travel support means including means for selectively lowering tube support members from said first shelf means and from said second shelf means, said selectively lifting means and said selectively lowering means being operable contemporaneously during at least a portion of their operations to effect loading of tube support members into said cross location transport means and unloading of tube support members from said cross location transport means.

5. In a textile production system, the transport assembly according to claim 4 and characterized further in that said first and second shelf means each include means defining a plurality of parallel guide channels, each guide channel for supporting a plurality of tube support members in a row parallel to the other row of tube support members.

6. In a textile production system, the transport assembly according to claim 5 and characterized further in that said selectively lifting means and selectively lowering means each include means defining a plurality of parallel guide channels, each guide channel for supporting a plurality of tube support members in a row parallel to the other rows of tube support members, and said guide channels of said selectively lifting means, said selectively lowering means and said first and second shelf means are arranged in alignment with one another for the guided movement of tube support members being transferred from said selectively lifting means to said first and second shelf means and from said first and second shelf means to said selectively lowering means and characterized further by control means for controlling the movement of said selectively lifting means and said selectively lowering means to permit the transfer of tube support members from a respective one of said first and second shelf means to said selectively lowering means in coordination with the transfer of tube support members from said selectively lifting means to the other one of said first and second shelf means.

7. In a textile production system, the transport assembly according to claim 6 and characterized further by displacing means for displacing a group of tube support members from said guide channels of said selectively lifting means into aligned ones of said guide channels of said respective one of said first and second shelf means.

8. In a textile production system, the transport assembly according to claim 7 and characterized further by a positioning means for selectively positioning said displacing means at said respective one of said first and second shelf means, said selectively positioning means being operable to raise and lower said displacing means along a vertical path in which said displacing means is in superposed relation above said selectively lifting means and characterized further by coordinating means for coordinating the vertical movements of said selectively lifting means and said displacing means, said coordinating means being operable to prevent upward movement of said selectively lifting means beyond the vertical position of said displacing means.

9. In a textile production system, the transport assembly according to claim 8 and characterized further in that said outgoing travel support means includes stationary collection means having a plurality of parallel guide channels, each guide channel for supporting a plurality of tube support members in a row parallel to the other rows of tube support members and said guide channels being aligned with said guide channels of said selectively lifting means, and means for moving tube support members along said guide channels, said stationary collection means being operable to temporarily store tube support members and to transfer tube support members to said selectively lifting means for subsequent lifting of the tube support members to said other one of said first and second shelf means.

10. In a textile production system, the transport assembly according to claim 9 and characterized further in that said means for moving tube support members along said guide channels of said stationary collection means includes a plurality of endless belts, each aligned with a respective one of said guide channels, and drive means for commonly driving said endless belts, said endless belts being operable to move tube support members along said guide channels of said stationary collection means to effect transfer of the tube support members to the aligned guide channels of said selectively lifting means.

11. In a textile production system, the transport assembly according to claim 10 and characterized further in that said stationary collection means is disposed at the respective exchange location associated with said at least one textile machine such that said first and second shelf means of said cross location transport means are disposed in superposed relation with said stationary collection means when said cross location transport means is disposed at said exchange location.

12. In a textile system, the transport assembly according to claim 7 and characterized further in that said displacing means includes a plurality of selectively extendable engaging means, each selectively extendable engaging means being extendable into a respective guide channel of said first and second shelf means in a direction parallel to the respective guide channel for engaging the adjacentmost one of the tube support members supported in the respective guide channel, the extending movement of the selectively extendable engaging means effecting abutting contact of the tube support members in the guide channels with one another and corresponding groupwise movement of the tube support members along the guide channels, said selectively lowering means being positionable at said respective one of said first and second shelf means for receiving the tube support members displaced from said guide channels of said respective one of said first and second shelf means by said selectively extendable engaging means.

13. In a textile production system, the transport assembly according to claim 12 and characterized further in that each of said selectively extendable engaging means is in the form of a coilable steel band and said displacing means includes a drive shaft and a drive motor operatively connected to said drive shaft for driving rotation thereof, each of said coilable steel bands being secured at one end to said drive shaft and said drive motor being operable to selectively rotate said drive shaft to selectively uncoil said coilable steel bands from coiled dispositions about said drive shaft to effect extension of said steel bands along said guide channels of said respective one of said first and second shelf means into engagement with the adjacentmost ones of the tube support members supported therein and for selectively coiling said coilable steel bands about said drive shaft to effect retraction of said steel bands from said guide channels of said respective one of said first and second shelf means.

14. In a textile production system, the transport assembly according to claim 6 and characterized further in that said selectively lowering means includes a platform member, a plurality of endless belts each in alignment with a respective one of said guide channels of said selectively lowering means and having its top run extending along the top surface of said platform member, and endless belt common drive means for commonly driving said endless belts, said platform member being positionable at said respective one of said first and second shelf means and said endless belt common drive means being operable to commonly drive said endless belts to effect the transfer of tube support members from said selectively lowering means for subsequent travel to said at least one textile machine.

15. In a textile production system, the transport assembly according to claim 14 wherein said at least one textile machine includes a linearly extending delivery path, said linearly extending delivery path for delivering tube support members received from said incoming travel support means to said at least one textile machine, the tube support members supported on the linearly extending delivery path being arranged in a single-file arrangement and characterized further in that said incoming travel support means includes reorienting travel means having a plurality of parallel guide channels aligned with said guide channels of said selectively lowering means, one of said guide channels of said reorienting travel means being aligned with the linearly extending delivery path, and aligning feed means for feeding tube support members from said guide channels of said reorienting travel means to the linearly extending delivery path, said reorienting travel means being operable to receive tube support members transferred thereto by said selectively lowering means and to reorient the tube support members supported in said guide channels of said reorienting travel means from a plurality of parallel rows which are offset from, and parallel to, the linearly extending delivery path to a single row of tube support members aligned with the linearly extending delivery path.

16. In a textile production system, the transport assembly according to claim 6 and characterized further in that said selectively lifting means includes a platform member, a plurality of endless belts each aligned with a respective one of said guide channels of said selectively lifting means and having its top run extending along the top surface of said platform member, and an endless belt drive means for commonly driving said endless belt, said endless belts being operable to transfer the tube support members supported in said guide channels of said selectively lifting means to the respective aligned guide channels of said other one of said first and second shelf means.

17. In a textile production system, the transport assembly according to claim 3 and characterized further by shelf lifting and lowering means, disposed at the respective exchange location associated with said at least one textile machine, for selectively lifting and lowering said first and second shelf means to position said first and second shelf means for the transfer of tube support members between said first and second shelf means and said incoming and outgoing travel support means.

18. In a textile production system, the transport assembly according to claim 17 and characterized further in that said shelf lifting and lowering means includes a selectively extendable and retractable cylinder and means for selectively extending and retracting said cylinder, said cylinder being vertically movable in an increment of travel corresponding to the spacing between said first and second shelf means.

19. In a textile production system, the transport assembly according to claim 17 and characterized further in that said incoming and outgoing travel support means are vertically spaced from one another by a spacing equal to the vertical spacing between said first and second shelf means and said incoming and outgoing travel support means each include a plurality of parallel guide channels, each guide channel for supporting a plurality of tube support members in a row parallel to the other rows of tube support members, and said first and second shelf means each include means defining a plurality of parallel guide channels, each guide channel for supporting a plurality of tube support members in a row parallel to the other rows of tube support members.

20. In a textile production system, the transport assembly according to claim 19 and characterized further in that said outgoing travel support means includes means for transferring tube support members from said guide channels of said outgoing travel support means into said guide channels of the other one of said first and second shelf means.

21. In a textile production system, the transport assembly according to claim 20 and characterized further by displacement means for displacing a group of tube support members from said guide channels of a respective one of said first and second shelf means onto said guide channels of said incoming travel support means.

22. In a textile production system, the transport assembly according to claim 21 and characterized further in that said displacing means includes a plurality of selectively extendable engaging means, each selectively extendable engaging means being extendable into a respective guide channel of said respective one of first and second shelf means in a direction parallel to the respective guide channel for engaging the adjacentmost one of the tube support members supported in the respective guide channel, the extending movement of the selectively extendable engaging means effecting abutting contact of the tube support members in the guide channels with one another and corresponding groupwise movement of the tube support members along the guide channels of said respective one of said first and second shelf means and into said guide channels of said incoming travel support means for subsequent transport of the tube support members to said at least one textile machine.

23. In a textile production system, the transport assembly according to claim 19 and characterized further said incoming and outgoing travel support means each include an endless belt assembly having an endless belt and means for driving said endless belt, said endless belt of said outgoing travel support means being operable to transport tube support members to said respective one of said first and second shelf means and said endless belt of said incoming travel support means being operable to transport tube support members from said respective one of said first and second shelf means.

24. In a textile production system, the transport assembly according to claim 23 and characterized further by lateral displacement means, said lateral displacement means including a member extending along one lateral side of the travel path of said endless belt of said outgoing travel support means parallel to the direction of movement of said endless belt and means for selectively moving said laterally extending member in a direction transverse to the direction of movement of said endless belt to displace a plurality of tube support members supported on said endless belt into said guide channels of said respective one of said first and second shelf means.

25. In a textile production system, the transport assembly according to claim 24 and characterized further by sensing means disposed upstream of said laterally extending member relative to the direction of travel of said endless belt of said outgoing travel support means and counting means operatively connected to said sensing means and said means for selectively moving said laterally extending member, said sensing means being operable to sense the travel therepast of each tube support member supported on said endless belt and said counting means being operable to increment a count of the number of tube support members by one in response to a signal from said sensing means and being operable to signal said means for selectively moving said lateral extending member to transversely move said laterally extending member when said count of tube support members equals a predetermined number of tube support members corresponding to the number of said guide channels of said respective one of said first and second shelf means.

26. In a textile production system, the transport assembly according to claim 1 wherein said cross location transport means includes first shelf means for supporting a first group of tube support members thereon, second shelf means for supporting a second group of tube support members thereon, and third shelf means for supporting a third group of tube support members thereon, said first, second, and third shelf means being in at least partially overlapping superposed relation to one another and said ongoing transfer means includes unloading transfer means for transferring tube support members from each of said shelf means to said incoming travel support means and loading transfer means for transferring tube support members from said outgoing travel support means to each of said shelf means, each of said unloading and loading shelf means being operable to selectively raise and lower tube support members from the respective associated travel support means to the selected one of said shelf means to which the tube support members are to be transferred and said unloading transfer means and said loading transfer means each being operable independently of the other said transfer means to transfer tube support members between the respective associated travel support means and said shelf means such that said unloading transfer means is operable to complete the transfer of tube support members between said first shelf means and said incoming travel support means and to move to a commence the transfer of tube support members between said second shelf means and said incoming travel support means during the uninterrupted transfer of tube support members by said loading transfer means between said outgoing travel support means and said third shelf means.

* * * * *